US010733967B2

(12) United States Patent
Trapp et al.

(10) Patent No.: US 10,733,967 B2
(45) Date of Patent: Aug. 4, 2020

(54) HANDPULL MUSICAL INSTRUMENT

(71) Applicant: Hohner Musikinstrumente GmbH, Trossingen (DE)

(72) Inventors: Thomas Trapp, Balgheim (DE); Knut Hoyer, Villingen-Schwenningen (DE)

(73) Assignee: Hohner Musikinstrumente GmbH, Trossingen (DE)

( * ) Notice: Subject to any disclaimer, the term of this patent is extended or adjusted under 35 U.S.C. 154(b) by 0 days.

(21) Appl. No.: 16/045,313

(22) Filed: Jul. 25, 2018

(65) Prior Publication Data

US 2019/0035368 A1 Jan. 31, 2019

(30) Foreign Application Priority Data

Jul. 26, 2017 (DE) ..... 10 2017 007 064

(51) Int. Cl.
*G10D 11/00* (2006.01)
*G10H 1/32* (2006.01)
*G10H 3/16* (2006.01)

(52) U.S. Cl.
CPC ..... *G10D 11/00* (2013.01); *G10H 1/32* (2013.01); *G10H 3/16* (2013.01); *G10H 2230/245* (2013.01)

(58) Field of Classification Search
CPC ..... G10D 11/00; G10D 11/02; G10H 3/16; G10H 1/32; G10H 2230/245
See application file for complete search history.

(56) References Cited

U.S. PATENT DOCUMENTS 1,781,394 A 11/1930 Candido et al.
1,922,381 A * 8/1933 Luttbeg ..... G10D 11/00 84/376 K (Continued)

FOREIGN PATENT DOCUMENTS

CH 55044 A 7/1912
DE 1 785 862 U 3/1959

(Continued)

OTHER PUBLICATIONS

European Search Report dated Dec. 20, 2018 in Patent Application No. 18000612.4, all pages.

(Continued)

*Primary Examiner* — Kimberly R Lockett
(74) *Attorney, Agent, or Firm* — Kilpatrick Townsend & Stockton LLP

(57) ABSTRACT

Handpull musical instrument comprising housing parts for treble and bass connected by a bellows (1), associated sound and/or signal producing equipment and mechanical parts, and comprising a treble keyboard (4) installed in the treble housing (2) and a bass keyboard (5) installed in the bass housing (3), wherein the treble housing (2) is configured as an columnar hollow body (6) in angular design, which is open on the bellows side and opposite thereto comprises an opening (7) for receiving a treble cover (8), wherein the treble cover (8) is arranged so as to be aligned at an acute angle to an instrument central plane (M) between the two housing parts (2, 3), such that the treble housing (2) is tapered towards the instrument front face (V) and, thereby, the treble cover (8) is displaced towards the front and the treble cover (8) forms the treble keyboard (4).

18 Claims, 6 Drawing Sheets

(56) References Cited

U.S. PATENT DOCUMENTS

Figure 2:
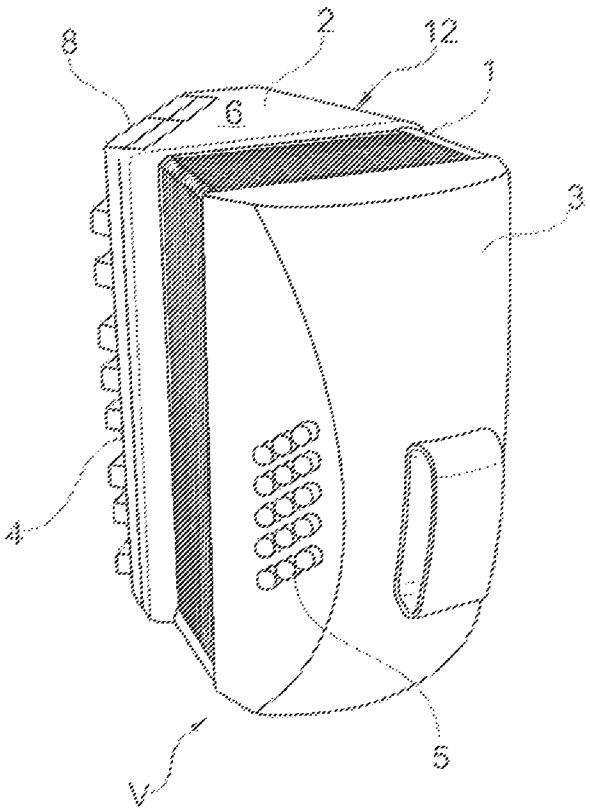

| | | | |
|---|---|---|---|
| 2,036,545 | A | 4/1936 | Otto |
| 2,056,212 | A | 10/1936 | Otto |
| 2,114,085 | A | 4/1938 | Frank |
| 2,514,978 | A | 7/1950 | Terlinde |
| 2,983,178 | A | 5/1961 | Searles et al. |

FOREIGN PATENT DOCUMENTS

| | | | |
|---|---|---|---|
| DE | 1785862 | U | 3/1959 |
| DE | 1 273 966 | B | 7/1968 |
| DE | 1273966 | B | 7/1968 |
| DE | 1 299 988 | B | 7/1969 |
| DE | 1299988 | B | 7/1969 |
| FR | 2 945 146 | A1 | 11/2009 |
| WO | 03-085637 | A1 | 10/2003 |

OTHER PUBLICATIONS

Office action dated Sep. 4, 2019 in European Patent Application No. 18000612.4, all pages.

* cited by examiner

HANDPULL MUSICAL INSTRUMENT

This application claims priority to German Patent Application No. 10 2017 007 064.4, filed Jul. 26, 2017, the disclosure of which is incorporated by reference herein in its entirety.

The invention relates to a handpull musical instrument comprising housing parts for treble and bass connected by a bellows according to the preamble of Claim 1.

Handpull musical instruments which have the keyboard attached in an angled configuration on the right-hand side, the treble, belong to the various types of accordion. This arrangement of the keyboard can be traced back to the first Viennese or the first French instruments.

From FR 2 945 146 A1 a diatonic accordion is known having mounting tables for mounting sound producing equipment to the treble and bass sides, which are inclined with respect to each other in order to achieve an enhanced sound effect. In addition, on the treble side a treble keyboard is arranged as an angled extension of the mounting table. The treble keyboard thus provides a fingerboard adjacent to the mounting table, the fingerboard forming an independent housing component detached from the mounting table. Handle levels known from common handpull musical instruments can thus be transferred to instruments having an improved sound effect.

It is known from DE 1 299 988 that the conventional constructions of accordions have one respective housing for the treble part and one respective housing for the bass part as basic components and at the same time as load-bearing parts of the entire instrument. Moreover, it is common to all constructions that the connection between the housings and the bellows is effected by means of bellows frames. The housings of the known constructions enclose the entire mechanism of the accordion which is accommodated therein. The housing for the treble part, which in particular accommodates the reed blocks bearing the bellows-driven reeds, is configured as a treble pan with a treble fingerboard fastened thereto for attaching the piano keyboard. The treble pan contains an outwardly oriented angled portion over its entire length on the side on which the fingerboard is connected thereto.

A musical instrument is known from DE 1 273 966 in which a conventional accordion part with reed blocks bearing bellows-driven reeds and a polyphonic electrical sound producing equipment with the associated electrical sound producing equipment and the associated electronic components are accommodated in one and the same instrument which is configured in the form of an accordion. In order to accommodate the reed blocks, the electronic sound producing equipment and the contact part in a housing, having approximately the same dimensions as those of a standard accordion, the following is provided. In contrast to a standard accordion, the outwardly oriented angled fingerboard with the key mechanism mounted thereon is displaced by a small amount, for example 1 to 5 cm, in the direction of the front face of the accordion. As a result, a correspondingly large space is created on the rear face of the fingerboard for accommodating a sound producing equipment. Such an instrument therefore differs only slightly from a conventional accordion with regard to dimensions and weight. Thus, with the alterations undertaken on the accordion, an attempt is made not to alter the appearance of what is regarded as a conventional accordion.

An accordion is known from DE 1 785 862, the external shape thereof being improved with regards to playing technique. A novel internal and external shape which is adapted to the anatomical and physiological features of the player and the modern playing method is proposed and consists in that the outwardly oriented and angled treble fingerboard is located with its base in the middle of the instrument and forms a right-angle relative to the treble cover.

A drawback with all of the previously disclosed shapes of accordion is that the natural body posture of the accordion player is not sufficiently taken into consideration.

It is therefore the object of the present invention to provide a handpull musical instrument, in particular an accordion, which is improved from an ergonomic point of view.

This object is achieved by the features of Claim 1.

Hereby, a handpull musical instrument, in particular an accordion, is provided, said instrument taking greater account of the ergonomic aspects of the accordion player by altering the shape of the treble housing and altering the positioning of the keyboard.

The arrangement, which has been used hitherto and already for a very long time, of the keyboard on the treble side on a fingerboard with an outwardly oriented angled implementation, in particular at an angle ranging from 20° to 30° relative to the front face of the instrument, has been abandoned. Hitherto, all accordion players had to adapt themselves to this arrangement. However, the arrangement is poor from an ergonomic point of view since it forces the player into a very unnatural posture, both of the hands which have to be significantly angled back and of the arms, since the elbows have to be pushed considerably to the front and to the side and the upper arm has to be pushed to the front. This unnatural posture from an ergonomic point of view very rapidly leads to tension and thus to further unpleasant accompanying symptoms for the player.

The invention does not rely on previous technical conditions in the instrument but on the optimal hand and arm posture for the player, for playing the handpull musical instrument, in particular the accordion. The reasons for the previous arrangement of the keyboard were also in the internal mechanical construction of the instrument. When pressing the key or the button on the treble side, via a simple lever connected directly to the key, a flap/valve which is also part of this lever is opened. As a result, air is allowed to flow through the reed block and thus onto the free reeds and excite these reeds into vibrations which chop the flowing air, whereby the actual sound of the instrument is produced. Since the flap has to ensure a specific minimum opening to produce a stable sound, the lever proportions from the key to the flap have to have the corresponding path length/stroke. At the same time, the space in the interior of the instrument, in particular in the treble housing, is limited so that the reed blocks may only be positioned in the instrument in a specific position with little degrees of freedom. Due to this positioning and the lever issues, an outwardly oriented angling of the fingerboard with the keyboard on the treble side has been regarded until now as absolutely necessary.

It is the merit of the inventors of the present invention to have recognized that there is an virtually ideal angle for the keyboard of the treble part according to ergonomic considerations which is implementable in the handpull musical instrument, in particular in the accordion. At the same time it is possible that the internal construction of the handpull musical instrument for the bellows-actuation of the reed blocks bearing the reeds is able to follow these specifications.

The solution according to the invention provides that the keyboard on the treble side is displaced to the front towards the front face of the handpull musical instrument, in particular the accordion, and is adaptable with regard to an angle to the human anatomy. Thus the handpull musical instrument, in particular the accordion, may be played in a relaxed and easy manner without the player having to twist unnaturally and become tense. By the solution according to the invention it is possible to play the "arm-hand line" without substantially angling back the hand. The shoulder region may be relieved of tension by the upper arms no longer having to be turned outwardly. Only the fingers have to be bent in an ergonomic movement for actuating the keys or buttons. Thus the player achieves an unprecedented, perfectly easy and relaxed playing experience. Specifically for children, this fact is a decisive factor since bad postures in childhood may lead to health consequences.

As a result of the fact that the treble cover forms the treble keyboard according to the invention, the sound and/or signal producing equipment as part of the inner mechanical structure of the instrument is positioned physically close behind the treble keyboard. The treble keyboard thus forms an upper shed having an overlap with a subjacent lower shed in which the sound and/or signal producing equipment is arranged. The overlap is a lateral overlap with respect to an instrument central plane, wherein the overlap may be chosen to have a partial or full overlap range. The upper and lower sheds are then preferably aligned in relation to the bellows of the handpull musical instrument. The shed height of the lower shed may be determined by the width of a front side surface of the columnar hollow body in angular design. The improved ergonomics are thus combined with an improved positioning of the sound and/or signal producing equipment with respect to the treble keyboard. The instrument thus allows for an improved balancing by weight.

In the handpull musical instrument according to the invention, it is also advantageous if reed blocks bearing bellows-actuated reeds, a polyphonic electrical sound or signal producing equipment and the associated electronic components may be accommodated together or alternatively in one and the same instrument, in particular in the treble housing and optionally in the bellows. Such an instrument allows to play either acoustically with reeds and a natural sound generation by flowing air or with an electronic sound and/or signal generation or with both types of sound generation at the same time. If it is an exclusively electronic musical instrument, this instrument has no acoustic sounds produced by air flowing through.

Further advantages and embodiments of the invention may be learnt from the following description and the dependent claims.

The invention is described in more detail hereinafter with reference to the exemplary embodiments shown in the accompanying drawings.

Figure 1:
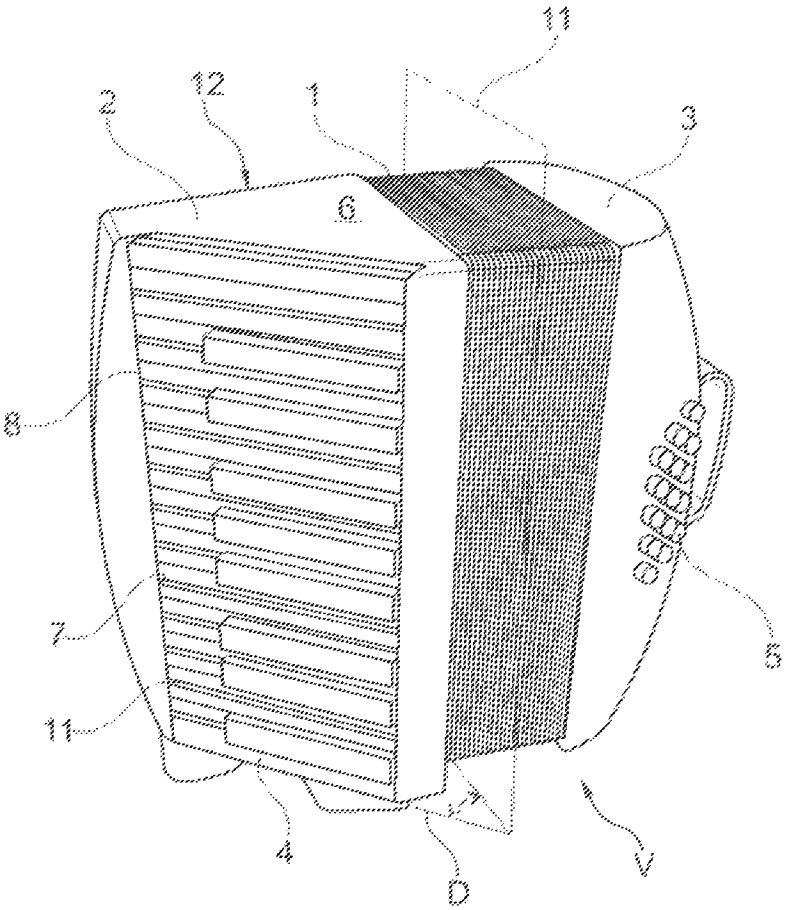
Figure 6:
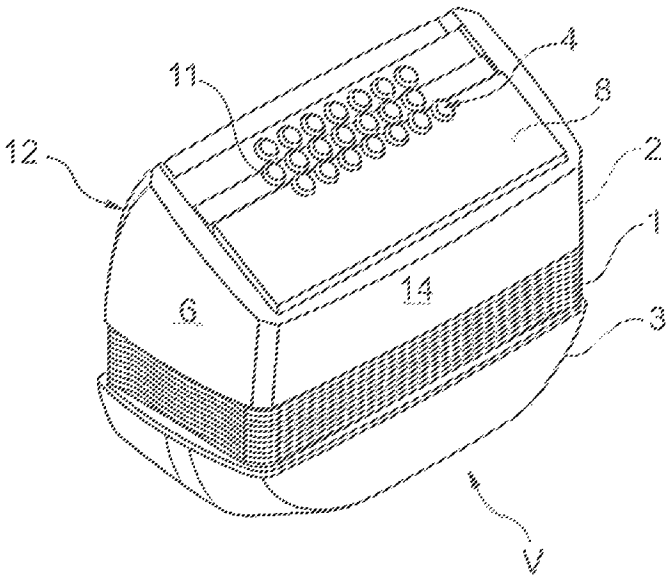
Figure 3:
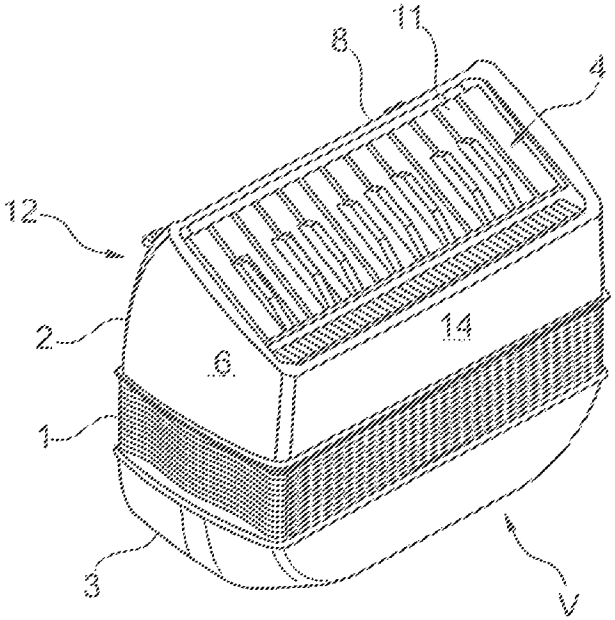
Figure 4:
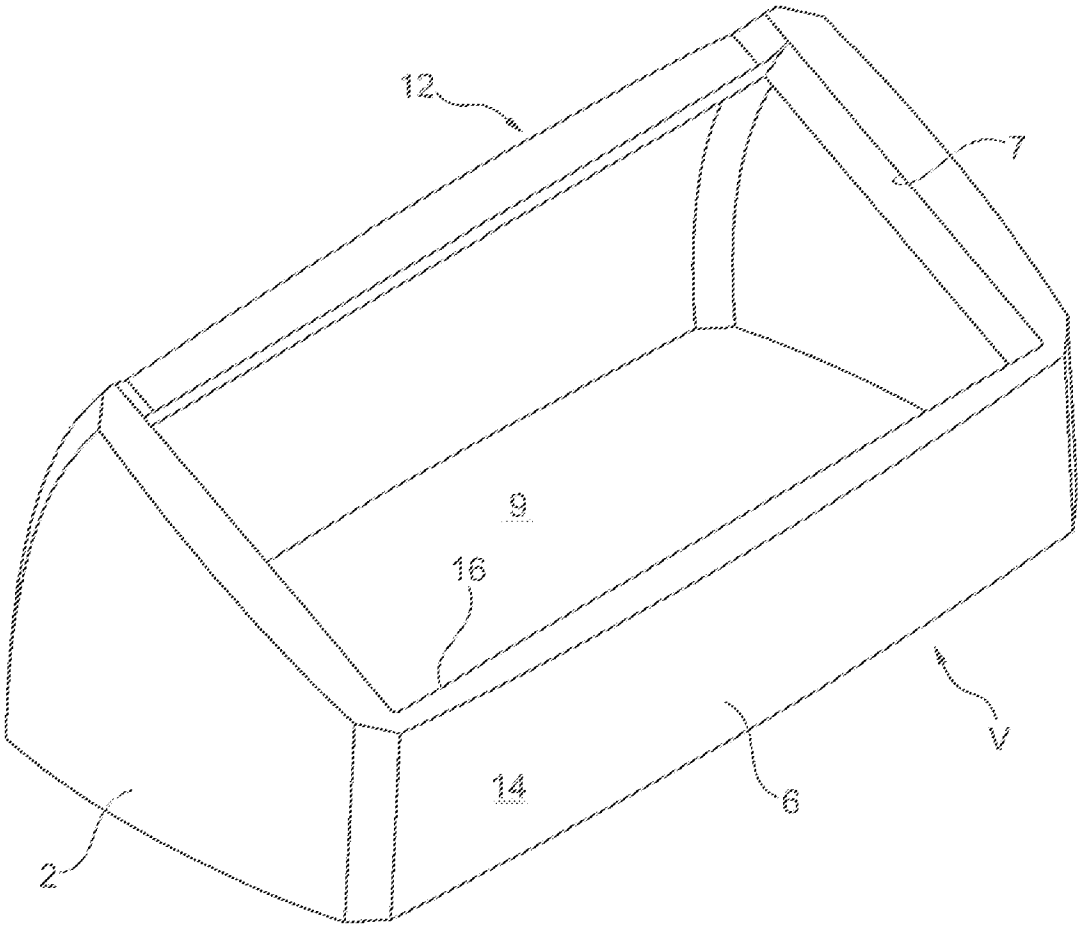
Figure 5:
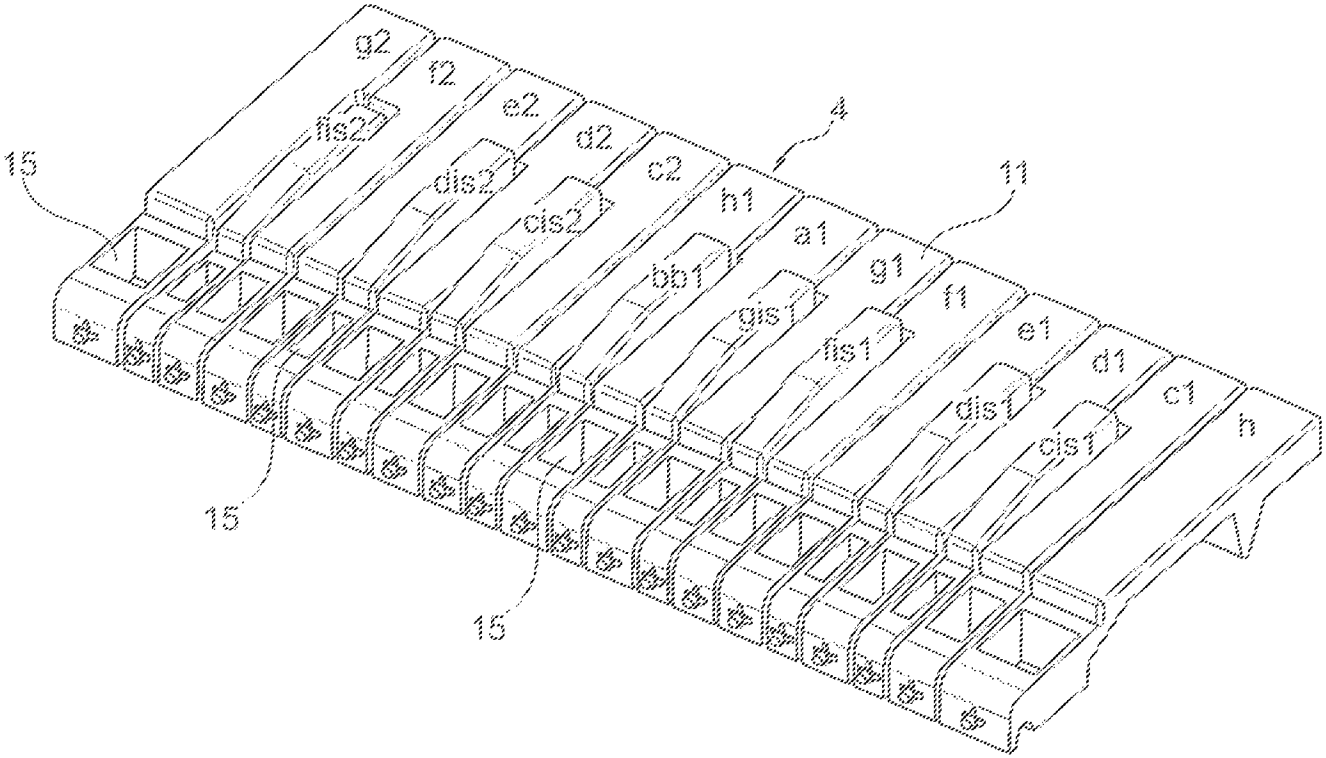
Figure 7:
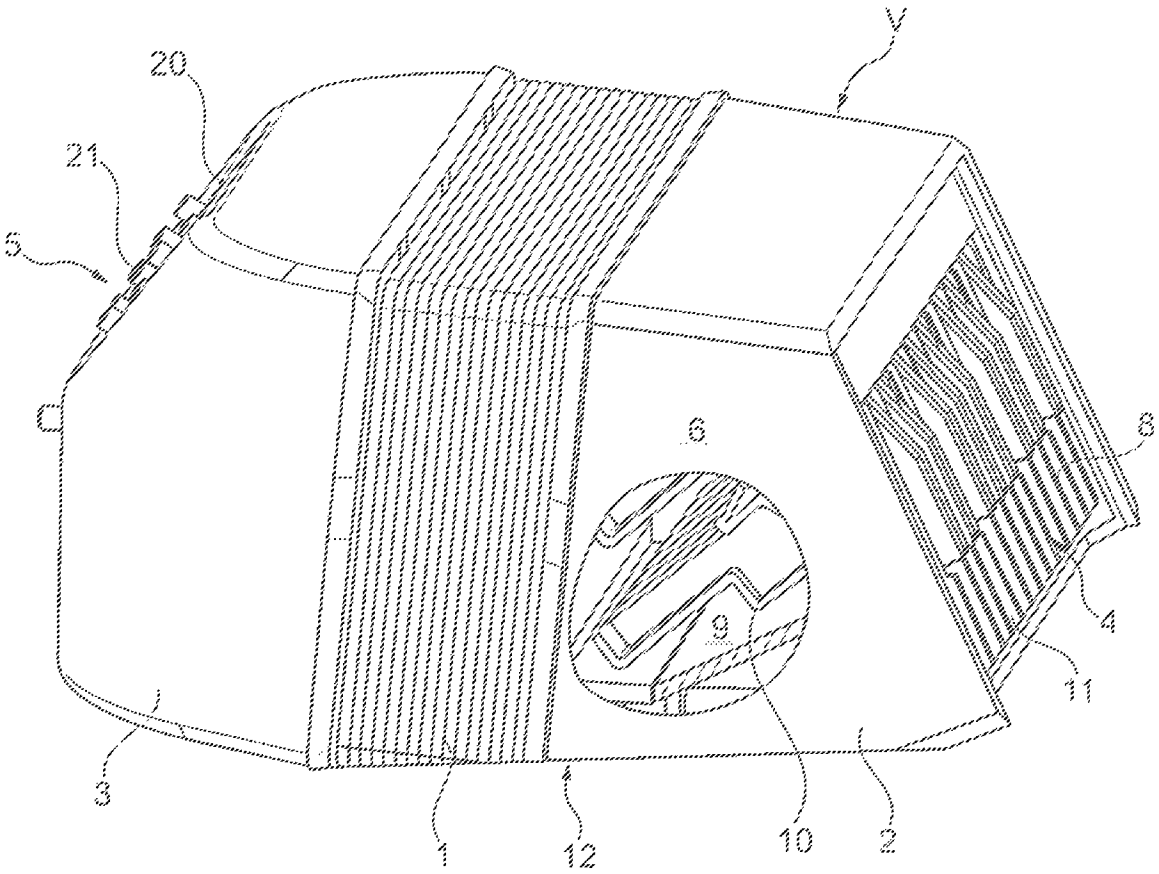
Figure 8:
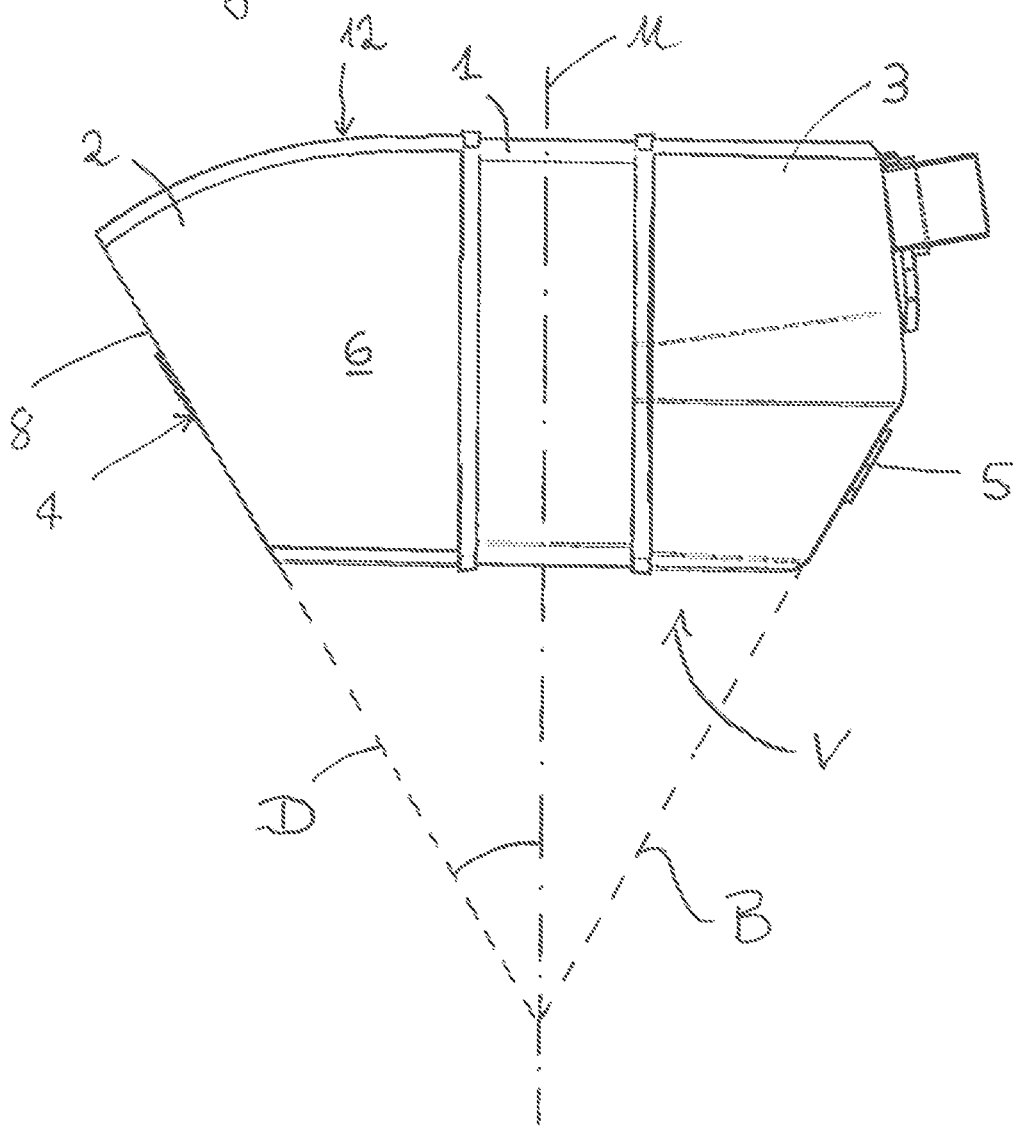

FIG. 1 shows schematically a perspective front view of a handpull musical instrument according to a first exemplary embodiment, FIG. 2 shows a perspective side view of the handpull musical instrument according to FIG. 1 in the direction of the bass housing, FIG. 3 shows schematically a perspective front view of a handpull musical instrument according to a second exemplary embodiment, FIG. 4 shows schematically a perspective front view of a treble housing of the handpull musical instrument according to FIG. 3, FIG. 5 shows schematically a perspective front view of the treble keyboard of the handpull musical instrument according to FIG. 3, FIG. 6 shows schematically a perspective front view of a handpull musical instrument according to a third exemplary embodiment, FIG. 7 shows schematically a perspective front view of a handpull musical instrument according to a fourth exemplary embodiment, FIG. 8 shows schematically a top view of the handpull musical instrument according to FIG. 7.

As shown in FIG. 1 and FIG. 2, the invention relates to a handpull musical instrument, in particular an accordion, with housing parts for treble, the treble housing 2, and bass, the bass housing 3, connected by a bellows 1. Moreover, the handpull musical instrument comprises the associated sound and/or signal producing equipment and mechanical parts (not shown). A treble keyboard 4 is installed in the treble housing 2 and a bass keyboard 5 is installed in the bass housing 3.

The treble housing 2 is configured as an columnar hollow body 6 in angular design, which is open on the bellows side and opposite thereto comprises an opening 7 for receiving a treble cover 8. The treble cover 8 is arranged so as to be aligned at an acute angle to an instrument central plane M between the two housing parts 2, 3, such that the treble housing 2 is tapered towards the instrument front face V and, thereby, the treble cover 8 is displaced towards the front. The treble cover 8 forms the treble keyboard 4. The treble keyboard 4 thus preferably closes the opening 7 of the columnar hollow body 6 in angular design and is thus integrated within the spatial shape of the treble housing 2. The treble housing 2 delimits, via the columnar hollow body 6 in angular design, a space 9 (see FIG. 4) which is suitable for accommodating the sound and/or signal producing equipment, valves, key mechanisms, etc.

The treble keyboard 4 is preferably arranged at such a distance from the bellows 1 that an arrangement plane D of the treble cover 8 passes through the instrument central plane M outside the instrument's base area. The treble keyboard 4 is preferably arranged in an angular range of 30° to 80° relative to the instrument central plane M.

The columnar hollow body 6 in angular design preferably has a cross section of a triangle or convex quadrilateral or pentagon, whereby the treble keyboard 4 displaced towards the front is orientable relative to the instrument central plane M at angles which take account of human anatomy and at the same time provide a hollow body 6 with sufficient dimensions for accommodating the sound and/or signal producing equipment. In the first exemplary embodiment shown in FIG. 1 and FIG. 2, the cross section of the columnar hollow body 6 in angular design of the treble housing 2 is substantially triangular with one side toward the bellows 1, one side toward the rear face 12 of the handpull musical instrument and one side toward the treble keyboard 4. The side surface 14 and the remaining side surfaces of the columnar hollow body 6 in angular design may be configured to be planar, curved and/or cornered.

The treble keyboard 4 and the bass keyboard 5 may be configured as a piano keyboard or a button keyboard. FIG. 1 and FIG. 2 show the treble keyboard 4 as a piano keyboard according to a first exemplary embodiment. The treble keyboard 4 in this case preferably has a vertical keyboard axis. As FIG. 1 and FIG. 2 also show, the bass keyboard 5, for example, has a button keyboard.

The treble housing 2 may be provided for delimiting a space 9 for accommodating reed blocks 10 bearing bellows-actuated reeds (see FIG. 7). In a preferably mechanical acoustic accordion the keys 11 of the treble keyboard 4 are connected to treble valves (not shown) which, actuated by bellows, control in a manner known per se the air flow through reed blocks 10 bearing the different reeds. Alternatively or additionally, the keys 11 may be provided individually with switches and/or contacts, etc. which serve for the individual control of electrical sound signal sources. These switches and/or signal producing equipment are known per se and are not shown.

A polyphonic electrical sound and/or signal producing equipment, which is known per se, together with the associated electronic components may be accommodated in the treble housing 2 according to the invention.

In the second exemplary embodiment shown in FIG. 3 to FIG. 5, the above applies accordingly. As in particular FIG. 4 shows, the columnar hollow body 6 in angular design is configured in cross section according to a convex quadrilateral and the width of the front side surface 14 is selected such that together with the tapering of the hollow body 6 and thus the angular alignment of the treble keyboard 4 relative to the instrument central plane M a spatial depth for the treble housing 2 is achieved which accommodates the sound and/or signal producing equipment and associated components, in particular when electronic sound and/or signal producing equipment is installed at the same time. The treble keyboard 4, however, is to be played in the same manner as in the first exemplary embodiment since the angular position relative to the instrument central plane M is selectable in the same manner.

As FIG. 4 in combination with FIG. 5 shows, the treble keyboard 4 is insertable into the opening 7, wherein the treble keyboard 4 has a number of sound outlet openings 15 for the air flowing through bellows-actuated reeds (not shown) for the production of sound. The sound outlet openings 15 may be configured in a region around the treble keyboard 4. When the treble keyboard 4 is configured as a piano keyboard as shown in FIG. 5, each key 11 is preferably configured with a sound outlet opening 15 along the edge 16 of the hollow body 6. The edge 16 is preferably arranged on the front side surface 14 of the hollow body 6. The keys 11 may have, for example, an extension portion as shown in FIG. 5, the respective sound outlet opening 15 being formed therein. As a result, a bar consisting of a plurality of sound outlet openings 15 can be provided. The width of the respective sound outlet opening 15 in this case may follow the width of the respective key 11 of the piano keyboard. The bass keyboard 5 may be configured in the same manner with a number of sound outlet openings (not shown).

FIG. 6 shows a third exemplary embodiment which differs from that shown in FIG. 3, by the treble keyboard 4 being configured as a button keyboard. Otherwise, the above-described applies accordingly.

As shown in FIG. 7, for example, the bass housing may have a fingerboard 20 for bass buttons 21, the handle level thereof being at an angle relative to the instrument central plane M. According to an exemplary embodiment, not shown, the handle level B of the bass buttons 21 may be arranged mirror-symmetrically to the treble keyboard 4. Moreover, FIG. 7 shows, via a cut-out, partial regions of a mechanical sound producing equipment in the treble housing 2.

FIG. 8 illustrates by means of a via top view of the handpull musical instrument according to the invention, in particular the accordion, the orientation of the treble keyboard 4 on the treble housing 2 relative to the front face V and rear face 12 of the instrument relative to the instrument central plane M.

According to an exemplary embodiment, not shown further, the treble cover 8 may be of roof-shaped configuration, wherein the treble keyboard 4 is preferably arranged on the roof side, that is directed towards the front face V of the instrument.

The treble cover 8 forms the treble keyboard 4 according to the invention, wherein the sound and/or signal producing equipment as part of the inner mechanical structure of the instrument is positioned physically close behind the treble keyboard 4, as shown in particular in FIG. 7 in conjunction with FIG. 8. The treble keyboard 4 thus forms an upper shed having an overlap with a subjacent lower shed in the form of the space 9, in which the sound and/or signal producing equipment, as in particular the reed blocks 10 according to FIG. 7, are arranged. The overlap is a lateral overlap with respect to an instrument central plane M (FIG. 8), wherein the overlap may be chosen to have a partial or full overlap range. The upper and lower sheds are then preferably aligned in relation to the bellows 1 of the handpull musical instrument. The shed height of the lower shed, or space 9, may be determined by a width of the front side surface 14 of the columnar hollow body 6 in angular design (FIG. 4).

Finally, according to the invention, the use of the above-described handpull musical instruments, as an accordion or other accordion type, chromatic or diatonic, is intended.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein the hollow body arranges the treble keyboard at such a distance from the bellows that an arrangement plane of the treble cover passes through the central plane outside a base area of the handpull musical instrument.

2. The handpull musical instrument according to claim 1, wherein the treble keyboard is arranged in an angular range of 30° to 80° relative to the central plane.

3. The handpull musical instrument according to claim 1, wherein the columnar hollow body in angular design has a cross section of a convex quadrilateral or pentagon.

4. The handpull musical instrument according to claim 1, wherein the treble keyboard is a piano keyboard or a button keyboard.

5. The handpull musical instrument according to claim 1, wherein the treble cover is of a roof-shaped configuration and the treble keyboard is configured on a roof side of the treble cover, that is directed towards the instrument front face.

6. The handpull musical instrument according to claim 1, wherein the treble keyboard has a vertical keyboard axis.

7. The handpull musical instrument according to claim 1, wherein the bass housing has a bass keyboard, a fingerboard of the bass keyboard defining a handle level which is arranged mirror-symmetrically to the treble keyboard relative to the central plane.

8. The handpull musical instrument according to claim 1, wherein the treble housing is provided for delimiting a space for accommodating reed blocks bearing bellows-actuated reeds.

9. The handpull musical instrument according to claim 1, wherein a polyphonic electrical sound and/or signal producing equipment together with associated electronic components are accommodated in the treble housing.

10. The handpull musical instrument according to claim 1, wherein in or in a region around the treble keyboard and/or the bass keyboard are a number of sound outlet openings for air flowing through bellows-actuated reed blocks for producing sound.

11. The handpull musical instrument according to claim 1, wherein the associated sound and/or signal producing equipment is positioned physically close behind the treble keyboard under formation of an upper and a lower shed having an overlap.

12. A method comprising using a handpull musical instrument according to claim 1 as an accordion or as another accordion type of chromatic or diatonic construction.

13. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein the columnar hollow body in angular design has a cross section of a convex quadrilateral or pentagon.

14. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein the bass housing has a bass keyboard, a fingerboard of the bass keyboard defining a handle level which is arranged mirror-symmetrically to the treble keyboard relative to the central plane.

15. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein the treble housing is provided for delimiting a space for accommodating reed blocks bearing bellows-actuated reeds.

16. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein a polyphonic electrical sound and/or signal producing equipment together with associated electronic components are accommodated in the treble housing.

17. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein in or in a region around the treble keyboard and/or the bass keyboard are a number of sound outlet openings for air flowing through bellows-actuated reed blocks for producing sound.

18. A handpull musical instrument comprising a treble housing part for a treble and a bass housing part for a bass connected by a bellows, an associated sound and/or signal producing equipment and mechanical parts; and comprising a treble keyboard installed in the treble housing part and a bass keyboard installed in the bass housing part, wherein the treble housing part is configured as an columnar hollow body in angular design, which is open on a bellows side and opposite thereto comprises an opening for receiving a treble cover, wherein the treble cover is arranged so as to be aligned at an acute angle to a central plane between the treble housing part and the bass housing part, such that the treble housing part is tapered towards an instrument front face and, thereby, the treble cover is displaced towards the front and the treble cover forms the treble keyboard; and wherein the associated sound and/or signal producing equipment is positioned physically close behind the treble keyboard under formation of an upper and a lower shed having an overlap.

* * * * *